United States Patent [19]

Hahn

[11] 4,376,455

[45] Mar. 15, 1983

[54] EIGHT HARNESS PAPERMAKING FABRIC

[75] Inventor: Edward R. Hahn, Neenah, Wis.

[73] Assignee: Albany International Corp., Albany, N.Y.

[21] Appl. No.: 220,806

[22] Filed: Dec. 29, 1980

[51] Int. Cl.[3] ..... D03D 15/00; D21F 1/10; B01D 39/10

[52] U.S. Cl. ..... 139/383 A; 139/425 A; 162/DIG. 1

[58] Field of Search ..... 139/383 A, 425 A, 420 R; 162/DIG. 1, 348, 358, 359; 245/2.8

[56] References Cited

U.S. PATENT DOCUMENTS

| | | | |
|---|---|---|---|
| 3,421,230 | 1/1969 | Ward | 139/425 A |
| 3,858,623 | 1/1975 | Lefkowitz | 139/425 A |
| 4,142,557 | 3/1979 | Kositzke | 139/425 A |
| 4,157,276 | 6/1979 | Wandel et al. | 162/348 |
| 4,161,195 | 7/1979 | Khan | 139/383 A |
| 4,184,519 | 1/1980 | McDonald et al. | 139/425 A |
| 4,239,065 | 12/1980 | Trokhan | 139/383 A |

FOREIGN PATENT DOCUMENTS

| | | |
|---|---|---|
| 582321 | 11/1946 | United Kingdom . |
| 2010346 | 6/1979 | United Kingdom . |

OTHER PUBLICATIONS

Grammar of Textile Design, by H. Nisbet 3rd Edition D. van Nostrand, Co. Inc., New York, 1927, pps.30 and 31 relied on.

A Handbook of Weaves, by G. H. Oelsner, The MacMillan Co., New York, 1915 pg. 18 relied on.

Thomas, "Betrachtung uber die Herstellung von Papiermaschinensieben" 1958, pp. 593-595 of Deutsche Textiltecknik with partial translation.

*Primary Examiner*—James Kee Chi

*Attorney, Agent, or Firm*—Quarles & Brady

[57] ABSTRACT

A papermaking fabric is woven from synthetic warp and weft threads in an eight harness weave pattern, and is characterized by having long knuckles of at least six crossovers in length in at least one thread system with a minimal number of interlacings of the threads in the fabric. In one embodiment, the long knuckles of each weave repeat of one thread system are six crossovers in length on one side of the fabric and the short knuckles of the system are two crossovers in length on the other side of the fabric. In a second embodiment, the long knuckles of each weave repeat of each thread system are seven crossovers in length and the short knuckles are one crossover in length.

11 Claims, 7 Drawing Figures

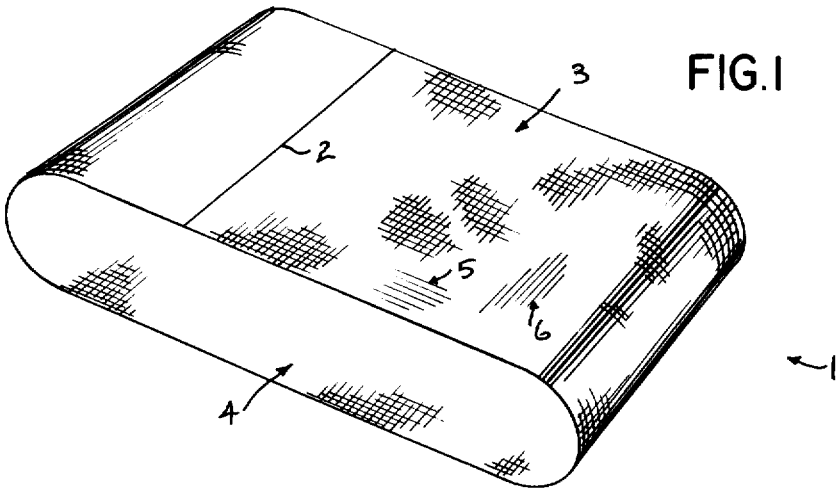
FIG.1
FIG.2
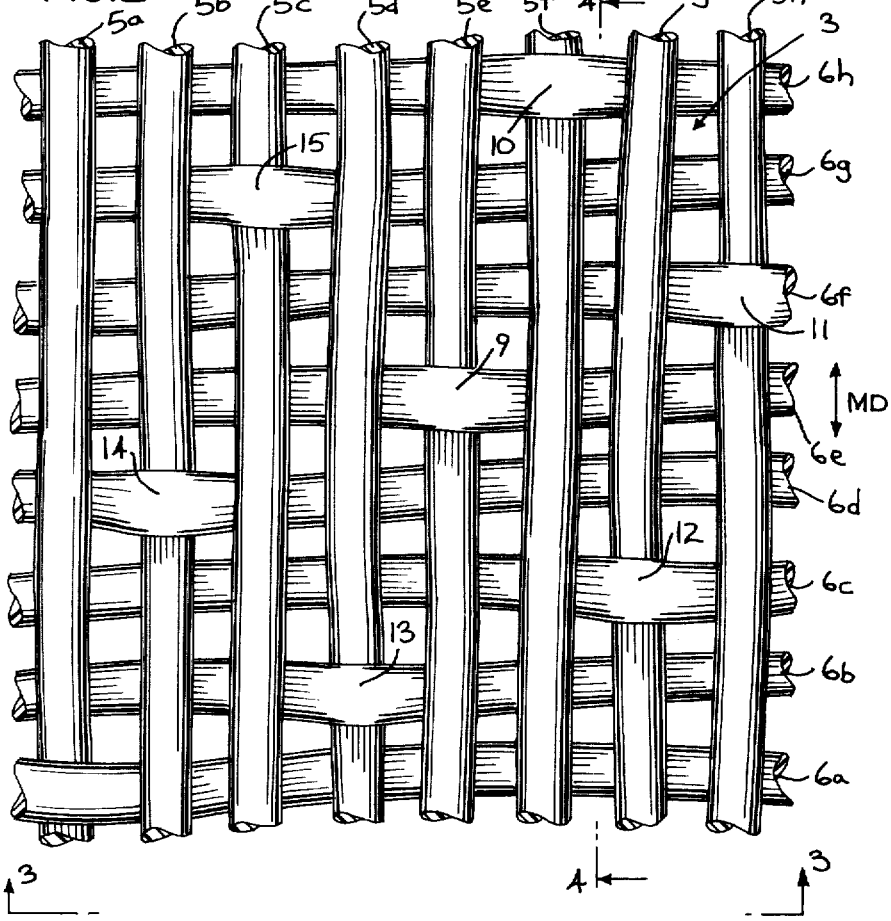
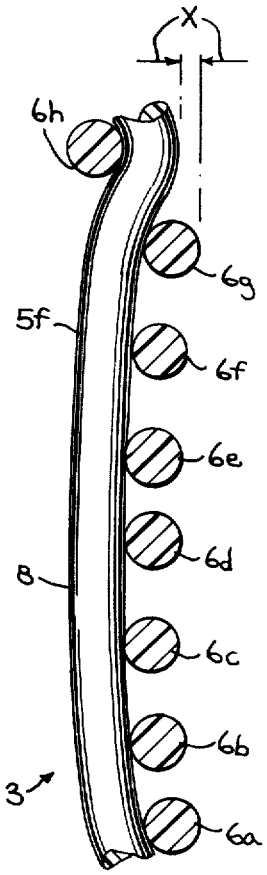
FIG.4
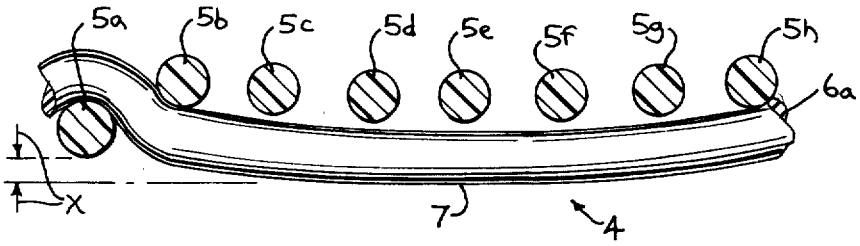
FIG.3

FIG.5
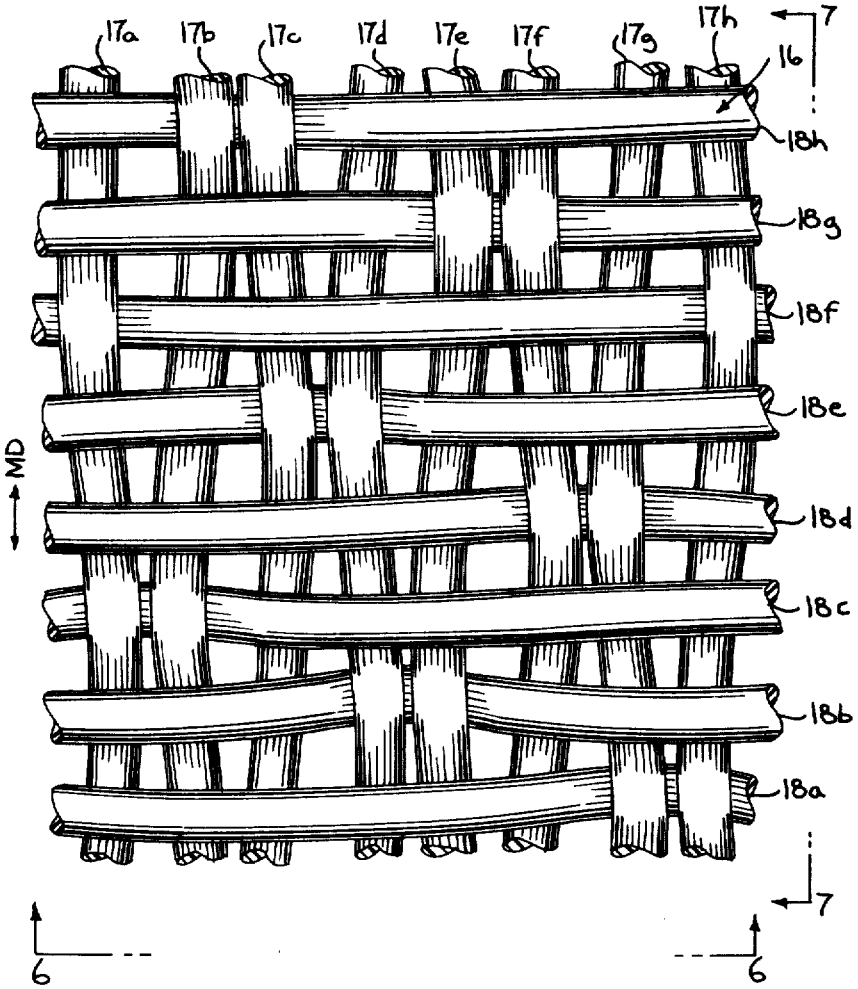
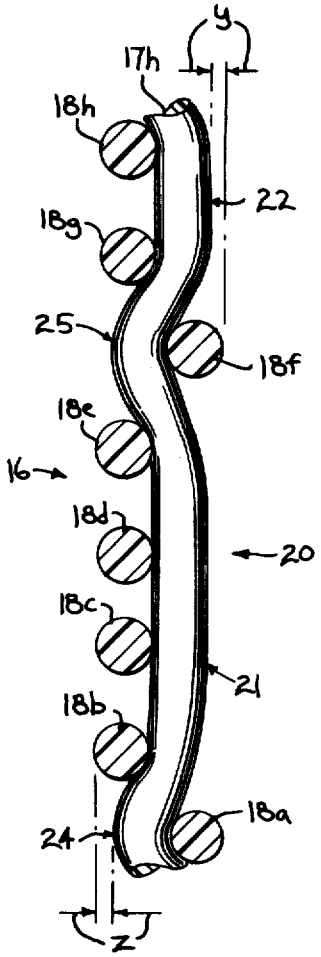
FIG.7
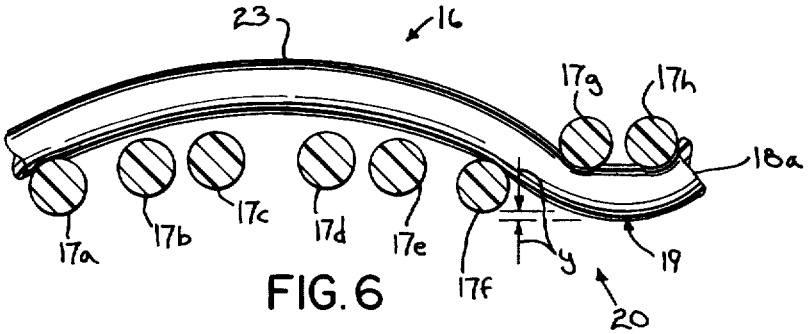
FIG.6

EIGHT HARNESS PAPERMAKING FABRIC

BACKGROUND OF THE INVENTION

The present invention relates to fabrics for use on papermaking machines, and more particularly to woven fabrics as used in the forming section of papermaking machines.

In the typical forming section of a papermaking machine, an aqueous suspension of paper pulp, known as "furnish", is evenly distributed onto a traveling forming fabric. The forming fabric is generally an endless, foraminous belt woven from threads of synthetic material. As the forming fabric travels through the forming section of the papermaking machine, water drains through the fabric to form a generally self-supporting continuous fiber mat or web on the fabric surface. When the fibrous web reaches the end of the forming section, it is picked up from the forming fabric and transferred to the press section of the papermaking machine, where additional water is squeezed from the web by passing it through the nips of a series of press rolls. The web is then transferred to a dryer section, where it is passed about a series of heated cylinders to evaporate still further amounts of water to yield the final paper sheet.

Forming fabrics pass over and around dewatering elements and machine rolls of the papermaking machine at high speeds and are subject to considerable abrasive wear. They must have a high resistance to such wear, and must also withstand tension loads imposed upon them as they are drawn through the paper machine without undue stretching or change in dimensional size. Forming fabrics must also provide a paper supporting surface which does not excessively mark the paper sheet, and from which the sheet may be readily released when it passes to the subsequent press section of the paper machine. The supporting surface should hold and retain the fibers with minimal loss through the fabric. Water drainage through the fabric should be uniform, and for certain paper grades the knuckle spacing and the openings in the fabric should be regular in character throughout the fabric to obtain uniformity in the paper web. Thus, a forming fabric must meet several stringent requirements concerning both its physical characteristics and its papermaking qualities.

Paperforming fabrics are normally woven from threads of synthetic material in a variety of weave patterns. Early synthetic fabrics were woven in one over-one under (1×1) plain weaves and one over-two under (1×2) semi-twill weaves in much the same fashion as metal wires which they supplemented. Subsequently, they have been commercially woven in one over-three under (1×3) and two over-two under (2×2) four harness patterns, and in one over-four under (1×4) and two over-three under (2×3) five harness patterns. There has also been some suggestion in the literature that one over-five under (1×5) six harness and two over-eight under (2×8) ten harness weaves might be employed for synthetic forming fabrics.

SUMMARY OF THE INVENTION

The present invention resides in a papermaking fabric having machine direction and cross machine direction thread systems that interlace with one another in an eight harness weave pattern to develop a stable fabric having desired papermaking qualities.

It is advantageous to provide fabrics in the forming section of a papermaking machine that have long thread knuckles and in which lesser portions of the thread lengths interlace, or pass through the fabric from one side to the other. Long knuckles, which are also at times referred to as floats, on the wear side of a fabric can increase fabric life by presenting more material to withstand abrasive wear caused by the fabric traveling over and around dewatering devices and rolls of the paper machine. It is particularly advantageous to have such long knuckles on the wear side formed in the cross machine threads, and to have these knuckles extend outwardly of the machine direction threads so as to take the bulk of the wear, for then the machine direction threads will retain their cross section areas for a longer period of use to better withstand the longitudinal tensions developed in the fabric as it is drawn across and around the paper machine elements. On the paper forming side, long thread knuckles can provide better fiber and paper support. Also, a corollary of providing longer knuckles is that the short knuckles forming binding points between the machine direction and cross machine direction threads become fewer in number and can be spaced further from one another. On the paper side this can result in less marking of the paper, which is a definite advantage in the manufacture of fine papers.

A result of using longer knuckles and higher harness counts for a weave repeat is the reduction in the interlacings of the threads through the fabric from one side to the other. For the machine direction threads the resulting reduction in thread crimp can decrease the straightening that tends to occur in these threads in response to tension forces. Fabric elongation and accompanying narrowing of the fabric in the cross machine direction then can be reduced to improve the running qualities of the fabric.

A reduction in the thread interlacings can also open up the interior of the fabric, so that its internal void volume is increased. A greater void volume allows water to flow at a faster rate through the fabric. This, in turn, allows the papermaker to increase the water content of his furnish to achieve a better dispersion of the pulp fibers. He can then better control the papermaking process in the forming section of the paper machine. Thus, it is advantageous to provide fabrics woven with higher harness counts.

However, lengthening thread knuckles and reducing the number of binding points between the two thread systems is thought to result in an unstable fabric. The threads can slide and shift position relative to one another. The openings in the fabric may lose uniformity, and requisite flatness and retention of shape of the fabric may be lost. In the present invention, it has been found that an eight harness fabric nevertheless can be made that has the requisites of a suitable fabric as discussed above. To achieve such a fabric the threads in at least one thread system have long knuckles comprising a minimum of six crossovers, and the thread densities are preferably at a value of at least 0.5. By the term "crossover" is meant the intersection where a thread of one system passes across a thread of the other system. "Thread density" is determined by multiplying the number of threads per unit width of fabric by the nominal thread diameter.

It is an object of the invention to provide a dimensionally stable eight harness paperforming fabric in which short thread knuckles are uniformly dispersed throughout the fabric at substantial distances from one another.

It is another object of the invention to provide a paperforming fabric having threads with relatively long knuckles which present a substantial surface area or interface for the support of paper fibers.

It is still another object of the invention to provide a paperforming fabric having a knuckle pattern which results in minimal marking of the paper web.

It is yet another object of the invention to provide a paperforming fabric that has relatively long knuckles for the cross machine direction threads on the wear side to absorb most of the abrasive wear and increase the working life of the fabric.

Another object of the invention is to provide a paperforming fabric that has enhanced water drainage capacity, due to reduced interlacings in the weave pattern which results in a greater void volume for the fabric.

The foregoing and other objects and advantages of the invention will appear from the following description. In the description, reference is made to the accompanying drawings which form a part hereof, and in which there is shown by way of illustration and not of limitation, preferred embodiments of the invention. Such embodiments do not represent the full scope of the invention, and reference is made to the claims herein for interpreting the breadth of the invention.

BRIEF DESCRIPTION OF THE DRAWINGS

FIG. 1 is a perspective view of a flat woven paperforming fabric of the present invention, FIG. 2 is a plan view of a portion of the paper supporting side of the fabric of FIG. 1 shown on an enlarged scale, FIG. 3 is a view in section of the fabric shown in FIG. 2 taken through the plane 3—3 extending along a cross machine direction thread, FIG. 4 is a view in section of the fabric shown in FIG. 2 taken through the plane 4—4 extending along a machine direction thread, FIG. 5 is a plan view of a portion of the paper supporting side of a second embodiment of the present invention shown on an enlarged scale, FIG. 6 is a view in section of the fabric shown in FIG. 5 taken through the plane 6—6 extending along a cross machine direction thread, and FIG. 7 is a view in section of the fabric shown in FIG. 5 taken through the plane 7—7 extending along a machine direction thread.

DESCRIPTION OF THE PREFERRED EMBODIMENTS

Referring to the drawings, FIG. 1 shows a paperforming fabric 1 that has been woven flat and joined at its ends by a seam 2 to form an endless belt. The fabric 1 has a paper supporting surface 3 which receives the aqueous suspension of paper fibers, or furnish, from the headbox of a papermaking machine, and a wear surface 4 that travels over and around the dewatering elements and rolls of the papermaking machine. The fabric 1 can be woven on a conventional loom from warp threads 5 that extend in the machine direction when installed on a paper machine, and shute threads 6 that will extend in the cross machine direction. After weaving, the fabric 1 is seamed and finished by heat treating under tension in the usual manner. Although described as being woven flat, the fabric 1 may also be woven endless, in which case the warp threads will extend in the cross machine direction, and the shute threads will extend in the machine direction of the belt. The fabric threads are preferably comprised of polyester, monofilament threads, but other polymeric materials and multifilaments may be used so long as they exhibit requisite physical characteristics for the finished fabric. Further, although the drawings illustrate a single layer fabric, the invention may be applicable to multi-ply fabrics, in which event the invention is applicable to one or more plies of the fabric.

Referring now to FIG. 2, the fabric 1 is woven in an eight harness weave, and the area of the paper supporting side 3 that is illustrated constitutes a single weave repeat in both the machine and cross machine directions. The machine direction threads 5 are sublabeled "a" through "h" and the cross machine threads 6 are also sublabeled "a" through "h". The machine direction is indicated by the double headed arrow at the right hand side of FIG. 2.

FIG. 3 illustrates the weave repeat for the cross machine thread 6*a*, which is the same as for the other cross machine threads. Commencing at the left, the thread 6*a* passes over and around the top of the machine direction thread 5*a* to form a short knuckle comprised of a single crossover. Such knuckle forms a binding point with the machine direction thread system, and the thread 6*a* then interlaces through the machine direction thread system and passes beneath a set of seven machine direction threads 5*b*–5*h* to form a long knuckle, or float on the wear side 4 of the fabric 1 comprising seven crossovers. Thread 6*a* then interlaces back through the machine direction thread system to complete a weave repeat. This repeat may be called a one by seven (1×7) weave and it is continued along the full length of the thread 6*a*, as well as along the lengths of all the other cross machine threads 6 in the fabric 1.

FIG. 4 illustrates the weave repeat for the machine direction thread 5*f*, which is the same as for all other threads 5. Commencing at the left, the thread 5*f* passes over a set of weft threads 6*a*–6*g* to form a long knuckle, or float of seven crossovers on the paper side 3 of the fabric 1. Thread 5*f* next interlaces through the cross machine thread system and passes beneath a single shute thread 6*h* to form a binding point with the cross machine thread system, and then finally interlaces back through the fabric 1 to complete a single weave repeat. Although this repeat is the inversion of that of the cross machine threads 6, it also is termed a one over-seven under (1×7) weave and is continued along the full length of all the threads 5.

As seen in FIGS. 2 and 3, the crests 7 of the long cross machine knuckles on the wear side 4 are spaced outwardly of the crests of the short knuckles of the threads 5, so as to be exposed on the wear side. This spacing is illustrated by the arrows "x" in FIGS. 3 and 4, and the crests 7 of the long cross machine knuckles lie in substantially the same plane so as to define the predominant bearing, or wear, surface for the fabric 1. The short machine direction knuckles comprised of single crossovers on the wear side 4 are recessed within the fabric and will have less wear, so that they will maintain their cross section areas for a longer period to sustain the tension loads imposed upon them as the fabric 1 is driven around the papermaking machine.

As seen in FIGS. 2 and 4, the long machine direction thread knuckles are on the paper suppporting side 3, and the crests 8 of these knuckles are shown as being at substantially the same level, or in the same plane, as the crests of the short knuckles of the cross machine threads. This common plane relationship of the two thread systems, which is attainable in the embodiment of FIGS. 2–4, provides a smooth supporting surface for paper formation. By referring to a common plane for the knuckle heights of the two thread systems on the paper side 3, it is meant that the level of the crests of the knuckles of the two thread systems are within about 0.0005 inches of one another. The orientation of the long knuckles on the paper supporting side in the machine direction also may be advantageous for minimizing paper marking for some grades of paper.

In addition to providing knuckles on the paper side that lie in a common plane, FIG. 2 shows another characteristic attainable by the invention. The short knuckles of the cross machine threads 6, which comprise single crossovers and form binding points with the machine direction threads 5, are substantially spaced from one another. For example, the knuckle 9 in FIG. 2 is surrounded by a cluster of six knuckles 10 through 15. Knuckles 12 and 15 are the closest to knuckle 9, and these are at a distance of two diagonally spaced crossovers. The other knuckles 10, 11, 13 and 14 are at a further distance, so that the binding knuckles on a fabric surface are well spaced throughout the fabric in a repeated pattern at distances of at least two diagonal crossovers. A twill pattern is eliminated, and marking in the manufacture of fine papers is reduced.

Another characteristic of the fabric 1 is its minimal vertical crimp in the machine direction threads 5. As seen in FIG. 4, each thread 5 has only two interlacings through the fabric in a weave repeat of eight crossovers. This reduces the crimp in the machine direction threads 5, and decreases the amount of fabric elongation that can occur by stretching out the crimp. Accordingly, the fabric 1 will better retain its length, and width reduction of the fabric, such as usually accompanies fabric elongation, is also reduced, so that dimensional stability of the fabric 1 is improved.

The fabric threads 5, 6 also have very little lateral crimp, so that they are substantially straight, as viewed from above in FIG. 2. This produces nearly rectangular openings that present a uniform drainage characteristic across the fabric. In addition, the reduced number of thread interlacings increases the void volume within the fabric. For example, the void volume for fabrics of the invention can be about 70%, as compared to 65% and less for prior five harness fabrics. This means that for given mesh counts and thread diameters water can drain through the fabric at faster rates than for fabrics of lower harness count. Water content of a furnish can then be increased, and this gives the papermaker the ability to improve fiber dispersion for aiding uniformity and control of the final paper product. Alternatively, the number of cross machine threads can be increased, while retaining the same drainage rate, and then the number of fabric openings are increased to achieve more uniform drainage. Such an arrangement can be desirable for certain paper grades.

The fabric 1 of FIGS. 2–4 may be seamed inside out, so that the long cross machine direction knuckles 7 become the paper supporting surface 3. This orientation may be advantageous for forming papers such as linerboard or bag paper. When the fabric is reversed in this fashion, on the wear side the short cross machine knuckles are raised from the long machine direction knuckles, so that they take more wear. This change in knuckle height can be accomplished in the heat setting of the fabric. The invention, consequently, is not limited to the particular fabric side on which the long knuckles of either thread system may be disposed.

FIGS. 5–7 illustrate a second embodiment of the invention. The fabric 1 of FIG. 1 is again illustrative, and a portion of the paper supporting side 16 is illustrated in FIG. 5. The fabric is again woven in an eight harness weave, and FIG. 5 depicts a single weave repeat in each direction. Warp threads 17 extend in the machine direction, and shute threads 18 extend in the cross machine direction. The machine direction is indicated by the double headed arrow at the left hand side of FIG. 5.

FIG. 6 illustrates the weave repeat for the cross machine direction thread 18*a*. Beginning at the left, the thread 18*a* passes over a set of six machine direction threads 17*a* through 17*f* to form a long knuckle, or float of six crossovers in length, then interlaces downwardly through the machine direction thread system to pass beneath a pair of machine direction threads 17*g* and 17*h* to form a short binding knuckle of two crossovers, and finally interlaces back through the machine direction thread system to complete a weave repeat. This repeat may be called a two by six ($2\times6$) weave repeat and is continued along the full length of the cross machine thread 18*a*, as well as along the lengths of all the other cross machine threads 18.

FIG. 7 illustrates the weave repeat for the machine direction thread 17*h*. Commencing at the left, the thread 17*h* passes over a single thread 18*a*, then interlaces downwardly through the cross machine thread system and passes beneath a set of four threads 18*b* through 18*e* to form a long knuckle of four crossovers, then interlaces back through the fabric and passes over a single cross machine thread 18*f*, then interlaces back through the cross machine thread system and passes beneath a pair of threads 18*g* and 18*h*, and then finally interlaces back through the fabric to complete a weave repeat. This repeat may be called a one by-four by-one by-two ($1\times4\times1\times2$) weave repeat, and is continued along the full length of the thread 17*h*, and also along the lengths of the other threads 17.

As seen in FIGS. 5 and 6, the second embodiment of the invention has its short cross machine knuckles 19 on its wear side 20. The crests of these short cross machine knuckles project beneath the crests of the machine direction knuckles 21, 22 on the wear side 20, as illustrated by the small arrows "y" in FIGS. 6 and 7. These short cross machine knuckles 19 thus become the predominant wear surface. The machine direction thread knuckles 21, 22 on the wear side 20 comprise a four crossover knuckle 21 and a two crossover knuckle 22 that may take some wear when the shorter cross machine knuckles 19 wear away, but the receded position of the machine direction knuckles 21, 22 will help maintain the thread cross sectional area, so as to withstand tension forces for a substantial fabric life.

FIGS. 5 and 6 show that the fabric has its long cross machine knuckles 23 on the paper supporting side 16, and FIG. 7 shows that in each weave repeat the fabric also has a pair of short machine direction thread knuckles 24, 25 each consisting of a single crossover in length, on the paper supporting side 16. The crests of the long cross machine knuckles 23 on the paper side are outwardly of the shorter machine direction knuckles 24, 25 as indicated by the arrows "z" in FIG. 7. These predominant knuckles 23 can play an important role in the paper forming process. As furnish flows from the headbox of a papermaking machine onto a forming fabric the fibers tend to align themselves in the machine direction. Maximum fiber support can be achieved for this condition by having long knuckles extending in the cross machine direction, for then the fibers can bridge across these knuckles which are crosswise to the principal direction of fiber alignment. This results in improved fiber retention, and also easier sheet release when the paper web is transferred to the press section of the paper machine.

Accordingly, the long cross machine direction knuckles on the paper supporting surface 16 of the fabric provide good fiber support and retention. These cross machine knuckles 23 are six crossovers in length, and provide dominant knuckles for the paper supporting surface 16 that are not attainable in fabrics of shorter weave repeats. Hence, the second embodiment can utilize protruding cross machine threads on both fabric sides that recess the machine direction threads on both sides, so that the machine threads can perform the primary function of tension members resisting elongation of the fabric. In this second embodiment some advantages of the first embodiment, such as a common plane on the paper forming side and uniform openings are sacrificed. But, the second embodiment finds advantageous use in the manufacture of brown papers such as linerboard, corrugating medium and bag paper where marking is not a problem as in fine papers. If desired, the second embodiment can also be inverted to place the long cross machine knuckles on the wear side, and the long machine direction knuckles on the paper side.

A further characteristic of the second embodiment is the development of lateral crimp in the machine direction threads 17. This helps bind the threads in position to reduce fabric elongation, and to some degree offsets the greater amount of vertical crimp in the machine direction threads of the second embodiment occasioned by four interlacings through the fabric in each weave repeat. The void volume of the second embodiment has also been maintained at a relatively high value of at least 70%. The short binding knuckles of the second embodiment are also dispersed in a non-twill pattern to lend stability to the fabric.

The two embodiments have been described as forming fabrics for the wet end of papermaking machines. However, the fabrics may also be used in other applications. The fabrics are woven in eight harness weave patterns, and are characterized by having long knuckles, or floats of at least six crossovers in the threads of at least one thread system. In one embodiment, the invention has an objective of reducing paper marking. To accomplish this the fabric provides long knuckles in the machine direction which are seven crossovers in length and which provide substantial areas of support in which the short crosswise knuckles are well spaced from one another. In the second embodiment, the invention has an objective of increased support for the paper fibers during formation of a web. This is accomplished by providing long cross machine direction knuckles of six crossovers in length. The uniform dispersion of knuckles throughout the fabrics of both embodiments contribute to their stability, and both embodiments exhibit desirable drainage characteristics because of a relatively high void volume due to the relatively few number of thread interlacings. Knuckle heights on both sides of the fabrics may be controlled, so that most of the abrasive wear is absorbed by cross machine threads for good life characteristics, and to develop a desirable paper formation surface on the outer face of the fabric.

To achieve a stable eight harness fabric it is believed thread densities should be quite high in each thread system. For the machine direction threads the density has usually run somewhat over a value of 0.5 and for the cross machine threads the value has run from slightly over 0.5 to nearly 0.8. In general, the average of the densities of the two thread systems should be at least a value of 0.5.

It has been found, as a unique result of the eight harness patterns of the invention, that the long knuckles of the cross machine threads can bow outwardly a substantial distance beyond the machine direction threads to produce desirable fabric characteristics. When the long cross machine knuckles form the wear surface they present a greater bulk of material to take wear, and when they are on the paper forming side they form crosswise bridges to support the fibers.

In the first embodiment, the plane difference between the crests of the long cross machine knuckles and the crests of the short machine direction thread knuckles has been from 80 to 115 percent of the cross machine thread diameter, and this plane difference has ranged from about 28 to 37 percent of the fabric thickness. In the second embodiment, the plane difference between the knuckle crests of the cross machine threads and the crests of the short machine direction thread knuckles has been from about 90 to 115 percent of the cross machine thread diameter. This plane difference can also be compared to the total fabric thickness, or caliper, and it has run from about 28 to 33 percent of the thickness. These large plane differences provide a fabric with special characteristics applicable to certain papermaking procedures, as discussed above.

Thusly, there is provided a papermaking fabric of an eight harness weave in which the threads of one thread system have long knuckles, or floats on one fabric side that are at least six crossovers in length, and the other thread system has binding knuckles, or points, on the same fabric side that are of only one crossover in length. In the first embodiment there is only one such binding point per weave repeat, and in the second embodiment there are two such binding points per weave repeat. The preferred fabric has a substantial plane difference running as high as 115% of the diameter of the raised thread. To enhance fabric stability the binding points are dispersed in a non-twill pattern, and preferably both thread systems have a density of at least about 0.5. The invention complements existing fabrics by providing a special fabric of unique character.

I claim:

1. In a papermaking fabric having machine direction and cross machine direction thread systems that interlace with one another to form thread knuckles in each thread system on opposite sides of the fabric, the combination of:

a weave repeat pattern of eight crossovers for each thread system;

the cross machine direction threads having long knuckles of at least six crossovers in length on the paper forming side of the fabric;

the machine direction threads having binding knuckles on the same fabric side of a single crossover;

the long knuckles of the cross machine direction threads on the paper side of the fabric extend outwardly of the machine direction thread knuckles; and the threads of both thread systems are of a polymeric material.

2. A fabric as in claim 1 in which the cross machine direction threads are woven in a 2×6 pattern and the machine direction threads are woven in a 1×4×1×2 pattern.

3. A fabric as in claim 1 wherein the thread densities of both thread systems are of a value of at least 0.5.

4. A fabric as in claim 1 wherein the plane difference between the knuckle crests of the two thread systems on one side of the fabric is at least about eighty percent of the thread diameter of the long knuckle threads on that fabric side.

5. A papermaking fabric as in claim 1, wherein the thread knuckles of the cross machine threads extend outward of the machine direction thread knuckles on both sides of the fabric.

6. A papermaking fabric as in claim 1 having a void volume of at least seventy percent.

7. In a papermaking fabric having machine direction and cross machine direction thread systems that interlace with one another to form thread knuckles in each thread system on opposite sides of the fabric, the combination of:

a weave repeat pattern of eight crossovers for each thread system;

threads of one direction being woven in a 2×6 pattern; and the threads of both thread systems being of a polymeric material.

8. A papermaking fabric as in claim 7 wherein:

the cross machine direction threads have long knuckles on one fabric side of six crossovers;

the machine direction threads have long knuckles on the opposite fabric side of four crossovers;

cross machine direction knuckles extend outwardly of the machine direction thread knuckles on the wear side of the fabric by at least twenty-eight percent of the fabric thickness; and the thread densities of each thread system are at least 0.5.

9. A fabric as in claim 8 wherein the plane difference between the cross machine and machine direction knuckles on the wear side of the fabric is at least eighty percent of the cross machine direction thread diameter.

10. A papermaking fabric having machine direction and cross machine direction thread systems that interweave with one another to form thread knuckles in each thread system on opposite sides of the fabric, comprising:

a weave repeat pattern of eight crossovers for each thread system;

threads of one thread system having four interlacings through the fabric in each weave repeat to form long knuckles of four crossovers in length; and threads of the other thread system having two interlacings through the fabric in each weave repeat to form long knuckles of six crossovers in length.

11. A papermaking fabric having machine direction and cross machine direction thread systems that interweave with one another to form thread knuckles in each thread system on opposite sides of the fabric, comprising:

a weave repeat pattern of eight crossovers for each thread system;

threads of one thread system having four interlacings through the fabric in each weave repeat to form two knuckles on one side of the fabric each of a single crossover in length, and two knuckles on the other side of the fabric, one of two crossovers in length and the other of four crossovers in length; and threads of the other thread system having two interlacings through the fabric in each weave repeat to form one knuckle on said one side of the fabric of six crossovers in length, and one knuckle on said other side of the fabric of two crossovers in length.

* * * * *